US009964928B2

(12) United States Patent
Yamauchi et al.

(10) Patent No.: US 9,964,928 B2
(45) Date of Patent: May 8, 2018

(54) TIME MEASURING CIRCUIT

(71) Applicant: DENSO CORPORATION, Kariya, Aichi-pref. (JP)

(72) Inventors: Shigenori Yamauchi, Nisshin (JP); Takamoto Watanabe, Nagoya (JP); Nobuyuki Taguchi, Nagoya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 478 days.

(21) Appl. No.: 14/817,271

(22) Filed: Aug. 4, 2015

(65) Prior Publication Data

US 2016/0041529 A1 Feb. 11, 2016

(30) Foreign Application Priority Data

Aug. 5, 2014 (JP) ..... 2014-159642

(51) Int. Cl.
*G04F 10/00* (2006.01)
*G04F 10/10* (2006.01)

(52) U.S. Cl.
CPC ..... *G04F 10/005* (2013.01); *G04F 10/105* (2013.01)

(58) Field of Classification Search
CPC ..... G04F 10/005; G04F 10/105
See application file for complete search history.

(56) References Cited

U.S. PATENT DOCUMENTS 4,772,843 A * 9/1988 Asaka ..... G04F 10/105 327/261
5,128,624 A * 7/1992 Hoshino ..... G01R 25/08 327/12
5,684,760 A * 11/1997 Hunter ..... G04F 10/04 368/120
5,818,797 A 10/1998 Watanabe et al.
5,963,510 A * 10/1999 Kudo ..... G04F 10/04 368/118
6,944,099 B1 * 9/2005 Preuss ..... G04F 10/005 324/76.54
7,516,032 B2 * 4/2009 Singh ..... G01R 29/02 368/118

(Continued)

FOREIGN PATENT DOCUMENTS

EP 0122984 A1 * 10/1984 ..... G04F 10/00

*Primary Examiner* — Mischita Henson
(74) *Attorney, Agent, or Firm* — Harness, Dickey & Pierce, P.L.C.

(57) ABSTRACT

A first encoding part encodes a reference timing determined by a reference clock by using a delay line. A second encoding part encodes a measurement start timing and a measurement end timing of a measurement period determined by a measurement signal to be measured by also using the delay line. A count part counts the reference clocks included in the measurement period. A fraction calculation part calculates a start fraction number indicating a time difference from the measurement start timing and an immediately-following reference timing and an end fraction number indicating a time difference from the measurement end timing to an immediately-following reference timing, based on the encoding result. The fraction calculation part then calculates a fraction data indicating a difference between the measurement period and a product of the period of the reference timing and the count value of the count part.

8 Claims, 11 Drawing Sheets

(56) References Cited

U.S. PATENT DOCUMENTS

| | | | | |
|---|---|---|---|---|
| 7,755,530 | B2 * | 7/2010 | Terazawa | H03M 1/502 341/155 |
| 8,228,763 | B2 * | 7/2012 | Henzler | G04F 10/04 327/276 |
| 9,667,262 | B2 * | 5/2017 | Yamauchi | H03L 7/0997 |
| 2005/0259239 | A1 * | 11/2005 | Lin | G01S 7/285 356/5.01 |
| 2010/0277158 | A1 * | 11/2010 | Lee | G04F 10/005 324/76.79 |
| 2011/0133973 | A1 * | 6/2011 | Yamamoto | G01R 31/31709 341/166 |
| 2012/0075137 | A1 * | 3/2012 | Tanizawa | H03M 1/0621 341/157 |
| 2013/0018631 | A1 * | 1/2013 | Chou | G04F 10/005 702/178 |
| 2016/0041529 | A1 * | 2/2016 | Yamauchi | G04F 10/005 702/176 |

* cited by examiner

BORDER FRACTION CALCULATION

| PATTERN | COMPARISON | | | OUTPUT | |
|---|---|---|---|---|---|
| | DR>DKB | DR>DK | DK>DKB | SUB | PM1 |
| DKB<DR<DK | 1 | 0 | 1 | DK-DR | 0 (NORMAL DETECTION) |
| DR<DK<DKB | 0 | 0 | 0 | | |
| DK<DKB<DR | 1 | 1 | 0 | | |
| DR<DKB<DK | 0 | 0 | 1 | DKB-DR | 1 (DELAY DETECTION) |
| DKB<DK<DR | 1 | 1 | 1 | | |
| DK<DR<DKB | 0 | 1 | 0 | | |

PERIOD FRACTION CALCULATION

| PATTERN | OUTPUT | |
|---|---|---|
| | RCH | PM2 |
| SUB_B>=SUB | SUB_B-SUB | 0 |
| SUB_B<SUB | SCW-(SUB-SUB_B) | 1 |

COUNT VALUE CORRECTION

| PATTERN | | | RCC |
|---|---|---|---|
| PM1 | PM1_B | PM2 | |
| 0 | 0 | 0 | CT |
| 0 | 1 | 0 | CT+1 |
| 1 | 0 | 0 | CT-1 |
| 1 | 1 | 0 | CT |
| 0 | 0 | 1 | CT-1 |
| 0 | 1 | 1 | CT |
| 1 | 0 | 1 | CT-2 |
| 1 | 1 | 1 | CT-1 |

TIME MEASURING CIRCUIT

CROSS REFERENCE TO RELATED APPLICATION

The present application is based on Japanese patent application No. 2014-159642 filed on Aug. 5, 2014.

FIELD

The present disclosure relates to a time measuring circuit, which realizes time measurement at high resolution.

BACKGROUND

It is conventional to measure time by using a ring oscillator, in which plural delay elements for delaying a pulse signal are connected in a ring form, and encoding the number of stages of the delay elements, through which the pulse signal passes in a period of measurement (refer to U.S. Pat. No. 5,818,797 corresponding to JP H10-54887 A, for example).

According to the conventional device, a variation in a measured time value increases as a period of measurement increases. This variation is considered to arise, because the delay time of individual delay element forming the ring oscillator varies with a variation of a power supply voltage, thermal noise and the like and this variation of the delay time accumulates in proportion to the number of the delay elements, through which the pulse signal passed.

In an application for detecting precisely a variation in a frequency, which has a sufficiently long period longer than milliseconds (ms) relative to the delay time of nanoseconds (ns) of the delay element, the error in the measured time value increases to be large relative to the variation in the frequency to be measured. This variation thus makes it impossible to attain the time measurement precisely.

In an actual experiment, a period of a signal, which is set to a predetermined frequency (oscillation period), was measured 2,000 times. This measurement was performed 2,000 times for each frequency, while changing the predetermined frequency. The measurement exhibited the following results. That is, as shown in FIG. 15A, a period (oscillation period) OP of a measurement signal, which is a signal to be measured, and an average of measured time values (frequency control data) were in a proportional relation. However, as shown in FIG. 15B and FIG. 15C, a width of variation (difference) PP between a maximum value and a minimum value of the measured time values and a dispersion σ, which indicates an average level of variation of the measured time values, increased as the measurement period became long (as a result, as the measured time value increased). It was confirmed specifically that the width of variation PP reached about 0.02% (200 ns) and the dispersion σ reached about 0.002% (20 ns) when the measurement period was about 1 ms (near a right top in each figure).

SUMMARY

The present disclosure addresses this problem and has an object to provide a time measuring circuit, which reduces a variation even in a case that a period to be measured is long.

According to one aspect, a time measuring circuit comprises a delay line, a first encoding part, a second encoding part, a count part and a fraction calculation part. The delay line has plural delay elements connected in series for delaying a pulse signal. The first encoding part performs an encoding operation, at every reference timing determined by a reference clock, in accordance with a number of stages of the delay elements, which the pulse signal passes through during a period from a preset start timing to the reference timing. The second encoding part performs an encoding operation with respect to a measurement start timing and a measurement end timing of a measurement period determined by a measurement signal inputted asynchronously from a reference signal, at every reference timing determined by the reference clock, in accordance with the number of stages of the delay elements, which the pulse signal passes through during the period from the preset start timing to the measurement start timing and from the preset start timing to the measurement end timing. The count part counts a number of periods of the reference clock included in the measurement period. The fraction calculation part calculates based on encoding results of the first encoding part and the second encoding part a start fraction and an end fraction. The start fraction indicates a time difference from the measurement start timing to the reference timing appearing first after the measurement start timing, and the end fraction indicates a time difference from the measurement end timing to the reference timing appearing first after the measurement end timing. The fraction calculation part further calculates from the start fraction and the end fraction a fraction data indicating a difference between the measurement period and a period, which is a product of the period of the reference timing and a count value of the count part, thereby to output a count data and the fraction data as a measurement value of length of the measurement period. Preferably, the count data is outputted by correcting the count value by correcting part so that the count data corresponds to the count value.

BRIEF DESCRIPTION OF THE DRAWINGS

The above and other objects, features and advantages of a time measuring circuit according to the present disclosure will become more apparent from the following detailed description made with reference to the accompanying drawings. In the drawings.

EMBODIMENT

Embodiments of a time measuring circuit will be described below with reference to the drawings.

First Embodiment

[Configuration]

Figure 1:
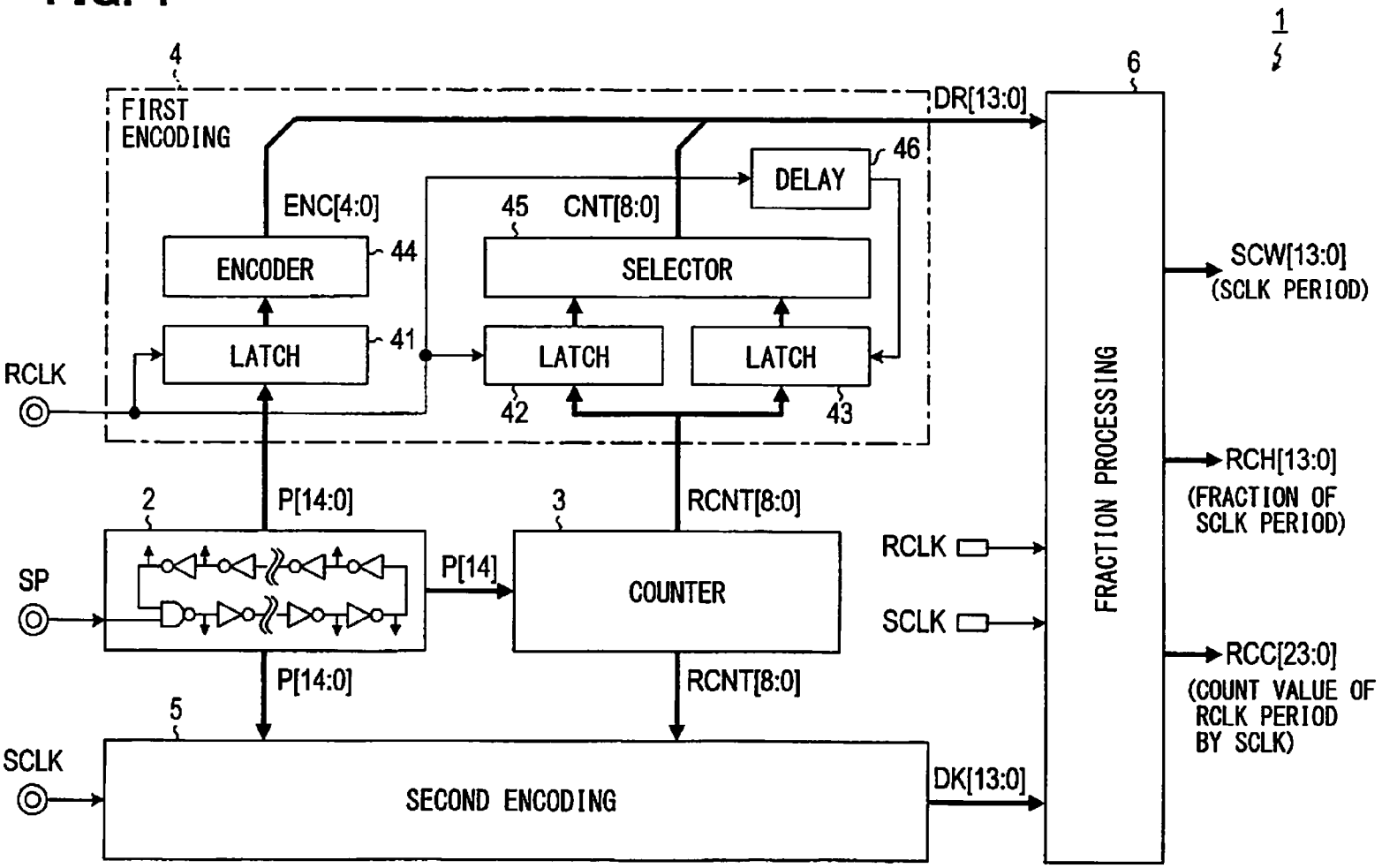
FIG. 1 is a block diagram showing a configuration of a time measuring circuit according to one embodiment.

As shown in FIG. 1, a time measuring circuit 1 includes a ring oscillator 2, a counter circuit 3, a first encoding part 4, s second encoding part 5 and a fraction processing part 6.

[Ring Oscillator]

The ring oscillator 2 uses an odd number of inverter circuits (fifteen inverter circuits, for example) as delay elements. The inverter circuits are connected in series and in a ring form by connecting an output of a last stage of the delay elements to an input of a first stage of the delay elements. The inverter circuit of the first stage is formed of a NAND gate having two inputs and the inverter circuit of the other stages are formed of inverter gates. One of two input terminals of the NAND gate, which is not used to form the ring form, is connected to an input terminal for externally inputting a start pulse signal SP. In the following description, a pulse output of the ring oscillator 2 is indicated as P[14:0]. However, a pulse output of each inverter circuit is indicated as P[i] (P=0 to 14) collectively. The pulse output of the inverter circuit of the first stage is indicated as P[0]. The pulse outputs of the inverter circuits of the second and subsequent stages are indicated as P[1] to P[14] in the order of serial connection, respectively.

According to the ring oscillator 2 configured as described above, when the start pulse signal SP is at a low level, the pulse output P[0] of the inverter circuit of the first stage is always at a high level irrespective of a signal level of the pulse output P[14] of the inverter circuit of the last stage. As a result, all the pulse outputs P[0] to P[14] stop changing and remain unchanged. In this stop state, the pulse output PM is at the high level. Assuming that a timing of a change of the start pulse signal SP from the low level to the high level is a start timing, the pulse output P[0] of the inverter circuit of the first stage inverts from the high level to the low level when the high level of the start pulse signal SP is held following the start timing. In the following stages, the pulse output of each inverter circuit inverts while being delayed at each inverter circuit stage and the pulse output P[14] changes to the low level. Thus, each time the pulse output P[0] of the inverter circuit of the first stage changes to the high level, an inverted edge of the signal level continues to circulate. The inverted edge changes from the low level to the high level or from the high level to the low level. Assuming that one inverted edge is a top edge with respect to any one of the pulse outputs P[i], a pulse signal is outputted at every two circulations of the inverted edge, that is, at every period of delay times of thirty stages of the inverter circuits.

[Counter Circuit]

The counter circuit 3 includes a counter of 9 bits, which operates with the pulse output P[14] of the ring oscillator 2 as a count clock. The counter circuit 3 counts up at a timing when the pulse output P[14] changes from the low level to the high level. As a result, a count value of the counter circuit 3 increments by one each time the pulse signal passes through 30 stages of the inverter circuits. When the counter circuit 3 further counts up under a state that the count value has reached its maximum value, the count value returns to 0 and the counter circuit 3 continues to count up. The output of the counter circuit 3 is indicated as RCNT[8:0].

[First Encoding Part]

The first encoding part 4 includes latch circuits 41, 42, 43, an encoder 44, a selector 45 and a delay circuit 46. Although the first encoding part 4 is conventional (for example, refer to JP-A-H07-183800), its operation is summarized as follows.

The latch circuit 41 latches the pulse output P[14:0] of the ring oscillator 2 at a timing of a rising edge of a measurement clock RCLK, which is inputted externally to be measured. The latch circuit 42 similarly latches an output RCNT[8:0] of the counter circuit 3 at a timing of the rising edge of the measurement clock RCLK. The latch circuit 43 latches the output RCNT [8:0] of the counter circuit 3 at a delayed timing, which is delayed one-half period of the measurement clock RCLK by the delay circuit 46.

The encoder 44 specifies a position, at which the input and the output of the inverter circuit in the ring oscillator 2 are at the same signal level, from the results latched by the latch circuit 41. The encoder 44 encodes the specified position of the inverter circuit into binary numbers indicating decimal numbers 0 to 30 in accordance with the specified position of the inverter circuit and the same signal level (high level or low level). An output of the encoder 44 is indicated as ENC[4:0].

The selector 45 selects an output of the latch circuit 42 when the output of the encoder 44 is ENC[4]=1 and selects an output of the latch circuit 43 when the output of the encoder 44 is ENC[4]=0 in accordance with a most significant bit (highest-digit bit) ENC[4] in the output of the encoder 44. The output, which the selector 45 selects, is indicated as CNT[8:0] below. Either one of the outputs latched at different timings is used selectively so that the count value, which is latched while it is still in an unstable state, is not supplied to subsequent processing.

The first encoding part 4 supplies a first measurement output DR[13:0] to the fraction processing part 6 at every timing of the rising edge of the measurement clock RCLK. The first measurement output is a data of a total of 14 bits, which is formed of the output ENC[4:0] of the encoder 44 as least significant bits (lower digits) and the output CNT [8:0] of the selector 45 as most significant bits (higher digits).

[Second Encoding Part]

The second encoding part 5 is configured similarly to the first encoding part 4 described above and hence description of its details will not be made. It is noted however that the second encoding part 5 is inputted with a reference clock SCLK in place of the measurement clock RCLK. Further, in place of the first measurement output DR[13:0], a second measurement output DK[13:0] is supplied to the fraction processing part 6 at every timing of a rising edge of the reference clock SCLK.

The reference clock SCLK is a clock, which is generated as the reference clock from an output of a crystal oscillator, for example, and is highly stable. The reference clock SCLK is set to have a period (for example, 100 ns), which is as long as about tens of times to hundreds of times of the delay time of each inverter circuit forming the ring oscillator 2. The reference clock SCLK and the counter circuit 3 are set to have a period and an output bit width, respectively, so that a time corresponding to a maximum value, which can be indicated by the first measurement output DR[13:0] and the second measurement output DK[13:0], becomes twice or more as long as the period of the reference clock SCLK. The reference clock SCLK is set to have a period, which is far shorter (for example, 1/100 or less) than the measurement clock RCLK. The first measurement output DR[13:0] and the second measurement output DK[13:0] are indicated simply as DR and DK below, respectively. Other symbols indicating plural bits are also indicated in a simplified manner.

[Fraction Processing Part]

Figure 2:
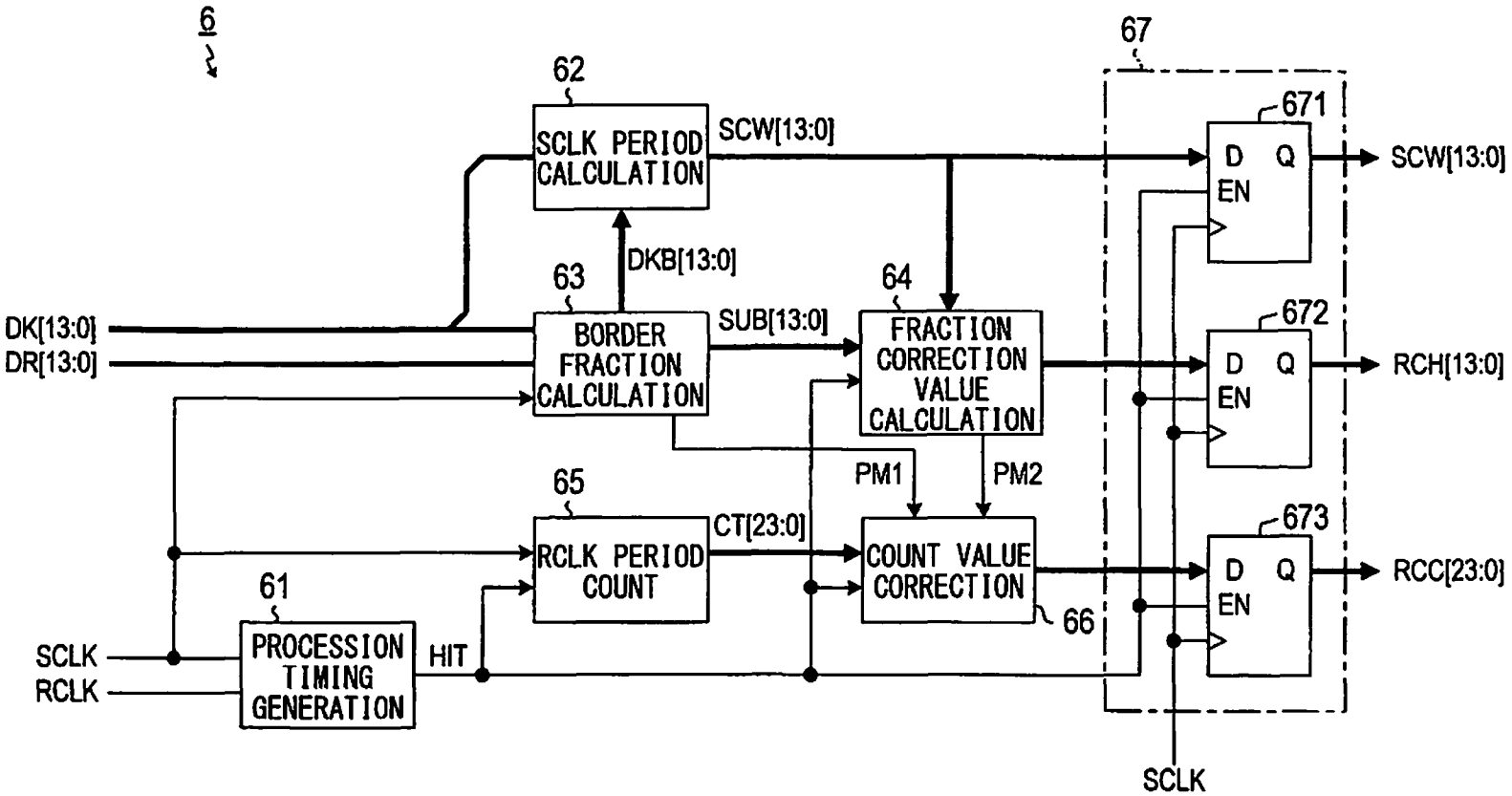
FIG. 2 is a block diagram showing a configuration of a fraction processing part shown in FIG. 1.

The fraction processing part 6 includes, as shown in FIG. 2, a processing timing generation part 61, a SCLK period calculation part 62, a border fraction calculation part 63, a fraction correction value calculation part 64, a RCLK period count part 65, a count value correction part 66 and an output part 67.

<Processing Timing Generation Part>

Figure 3:
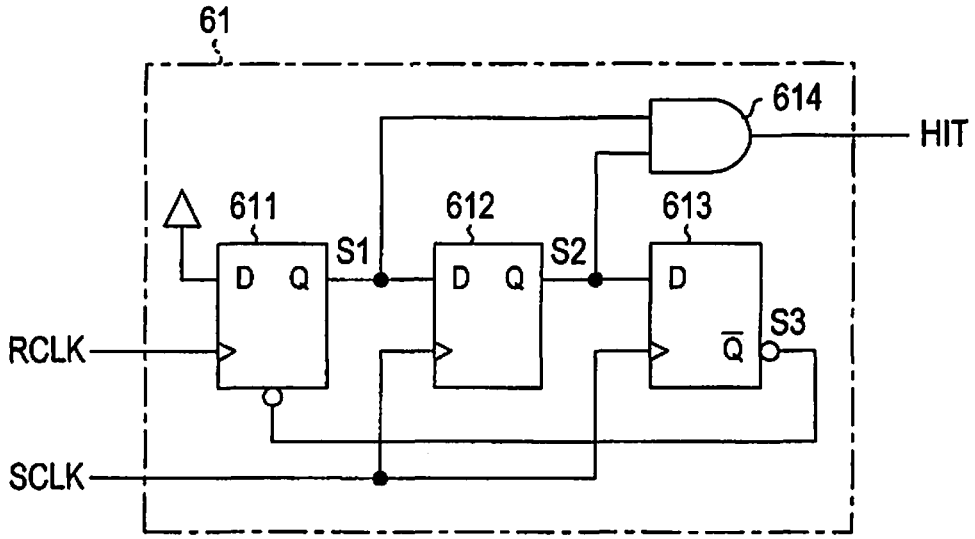
FIG. 3 is a circuit diagram showing a configuration of a processing timing generation part shown in FIG. 2.

The processing timing generation part 61 includes, as shown in FIG. 3, latch circuits 611, 612, 613 and an AND gate 614. The latch circuit 611 changes its output S1 to a high level at a timing of a rising edge of the measurement clock RCLK (referred to as RCLK timing below). The latch circuit 612 generates an output S2, which corresponds to a signal level of the output S1 latched at a timing of a rising edge of the reference clock SCLK (referred to as SCLK timing). The latch circuit 613 latches a signal level of the output S2 at the SCLK timing and generates its output S3 by inverting the signal level of the latched output S2. This output S3 is inputted to a reset terminal R of the latch circuit 611 and resets the output S1 of the latch circuit 611 to a low level when the output S3 is at a low level. The AND gate 614 outputs a high level when the outputs S1 and S2 are both at the high level. The output of the AND gate 614 is supplied to each part in the fraction processing part 64 as a processing timing signal HIT as shown in FIG. 2.

In the processing timing generation part 61 configured as described above, as shown in FIG. 4, the output S1 changes from the low level to the high level at the RCLK timing. Then, the output S2 changes from the low level to the high level at the first SCLK timing. With this change, the processing timing signal HIT also changes from the low level to the high level. At the subsequent timing SCLK, the output S3 changes from the high level to the low level. Since the latch circuit 611 is reset with this change, the output S1 changes from the high level to the low level and the processing timing signal HIT also changes from the high level to the low level. At the subsequent SCLK timing, the output S2 changes from the high level to the low level and the output S3 changes from the low level to the high level. Then this state is maintained until the RCLK timing arrives again.

That is, each time the RCLK timing is detected, the processing timing signal HIT generated by the processing timing generation part 61 changes to the high level at the SCLK timing, which is immediately following the RCLK timing, and changes to the low level further at the next SCLK timing. Thus, the high level is maintained only for one period of the reference clock SCLK. This period of the SCLK clock is referred to as a processing period below. Since the measurement clock RCLK and the reference clock SCLK are not synchronized, the output S2 of the latch circuit 612 cannot change its level at the first SCLK timing and changes its level to the high level at the next SCLK timing in a case that the period from the RCLK timing to the first SCLK timing is short. In this case, the processing timing signal HIT remains at the high level for a period from the second SCLK timing to the third SCLK timing after detection of the RCLK timing. In the following description, cases that the processing timing signal HIT becomes high at the first SCLK timing and the second SCLK timing after detection of the RCLK timing are referred to as a normal detection state and a delayed detection state, respectively.

<RCLK Period Counting Part>

Figure 4:
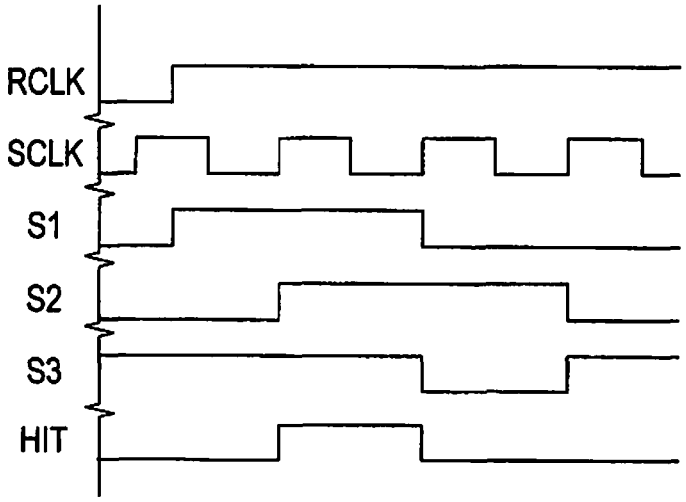
FIG. 4 is a timing diagram showing an operation of the processing timing generation part shown in FIG. 3.

Referring back to FIG. 2, the RCLK period count part 65 outputs at every rising edge of the processing timing signal HIT a count value, which is counted by the reference clock SCLK during a period from the previous rising edge to the present rising edge as shown in FIG. 4. Specifically, the RCLK period count part 65 resets the count value to 0 at the rising edge of the processing timing signal HIT and subsequently increments the count value by one at every SCLK timing. The RCLK period count part 65 then resets the count value to 0 at the timing of the rising edge of the next processing timing signal HIT and holds to output the count value, which is counted immediately before being reset, as a count result.

<Border Fraction Calculation Part>

Figures 5, 6:
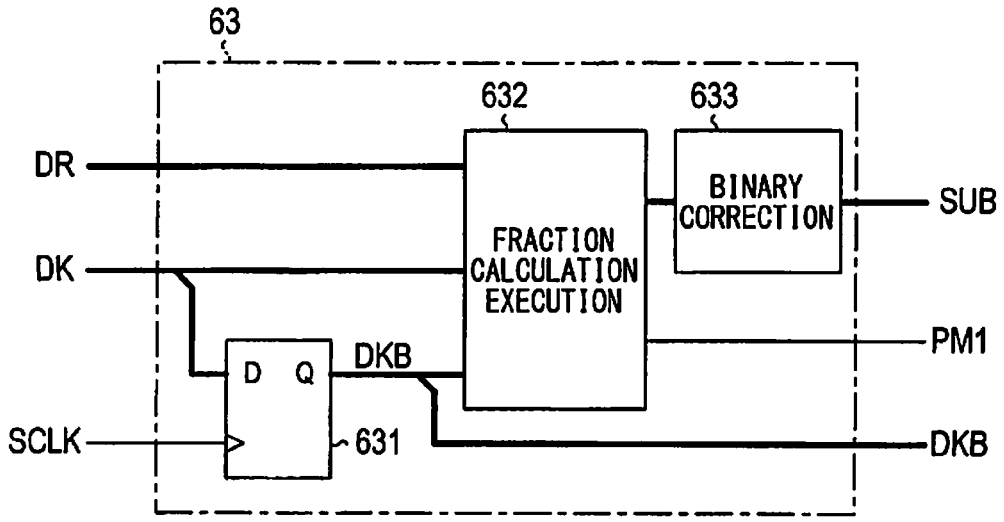
FIG. 5 is a block diagram showing a configuration of a border fraction calculation part shown in FIG. 2.
FIG. 6 is a table showing contents of processing of the border fraction calculation execution part shown in FIG. 5.

The border fraction calculation part 63 includes, as shown in FIG. 5, a latch circuit 631, a fraction calculation execution part 632 and a binary correction part 633. The latch circuit 631 latches a second measurement output DK at the SCLK timing. The fraction calculation execution part 632 compares the first measurement output DR, the second measurement output DK and the output DKB, which is latched by the latch 631 one clock before, and generates a fraction calculation value SUB and a first correction value PM1 from comparison results in accordance with a table shown in FIG. 6.

Figure 7A:
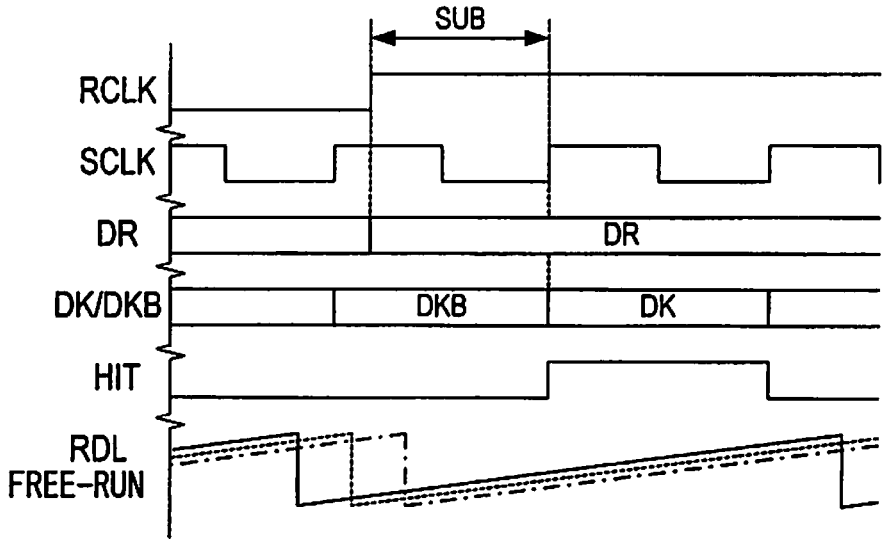
FIG. 7A and FIG. 7B are timing diagrams related to contents of setting of the table shown in FIG. 6 under a normal detection state and a delay detection state, respectively.
Figure 7B:
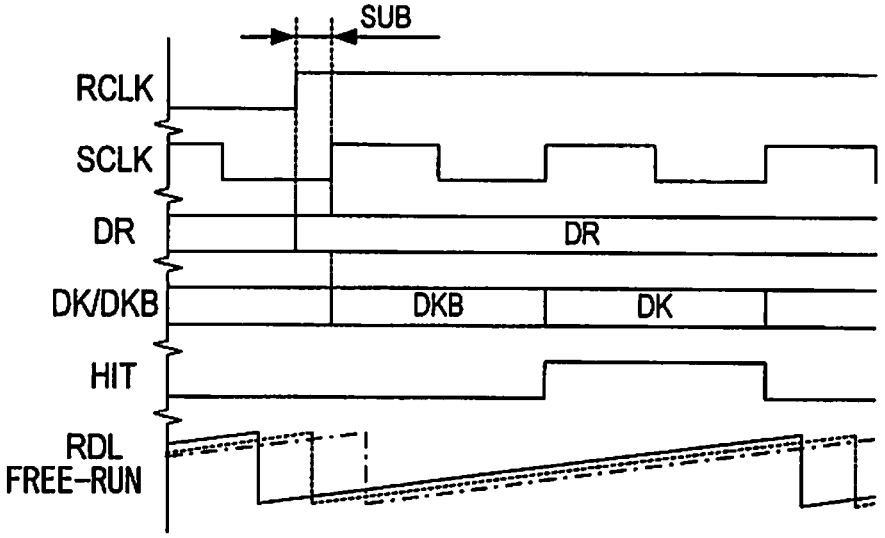

The fraction calculation value SUB indicates the number of stages of the inverter circuits which the pulse signal passed through in the ring oscillator 2 during a period from the RCLK timing to the SCLK timing, which is immediately following the RCLK timing. In the normal detection state, SUB=DK−DR as shown in FIG. 7A. In the delayed detection state, SUB=DKB−DR as shown in FIG. 7B.

Here, the first measurement output DR and the second measurement output DK indicates RDL free-run (values indicated by outputs P, RCNT of the ring oscillator 2 and the counter circuit 3), which are latched at timings of the rising edges of the measurement clock RCLK and the reference clock SCLK. The RDL free-run repeats values from 0 to an upper limit value as shown in FIG. 7A and FIG. 7B and is not synchronized with any of the clocks RCLK and SCLK. For this reason, it does not necessarily hold that DK, DR and DKB satisfy DK≥DR and DKB≥DR. However, in a case of DK<DR and DKB<DR, the left-most significant bits of DK and DKB are assumed to be 1. With this assumption, the above-described subtraction processing is executed so that the fraction calculation value SUB always becomes a negative value.

Since the period of the RDL free-run is set to be two times or more as large as that of the reference clock SCLK, each relation of DK, DR and DKB relative to the RDL free-run is summarized in three patterns in any states of normal detection and delayed detection. That is, it may be determined to be the normal detection state in cases of DKB<DR<DK (solid line), DR<DK<DKB (dotted line) and DK<DKB<DR (one-dot chain line) as shown in FIG. 7A. Further, it may be determined to be the delayed detection state in cases of DR<DKB<DK (solid line), DKB<DK<DR (dotted line) and DK<DR<DKB (one-dot chain line) as shown in FIG. 7B.

Since the RCLK period count part 65 starts and ends its counting operation in correspondence to the processing timing signal HIT, the starting and ending of the counting is delayed by one clock. To indicate this, the first correction value PM1 is set to PM1=0 (count value need not be corrected) in the normal detection state and set to PM1=1 (count value need be corrected) in the delayed detection state.

The binary correction part 633 corrects the fraction calculation value SUB calculated by the fraction calculation execution part 632 to a value represented in a binary code. The values SUB_U of left-most significant 9 bits of the first measurement output DR and the second measurement output DL (specifically, fraction calculation values SUB), which are based on the outputs of the counter circuit 3, are counted up by one each time the value indicated by right-most least significant 4 bits reaches 30. For this reason, the corrected fraction calculation value SUB is outputted as SUB-SUB_U×2 by subtracting from the fraction calculation value SUB a value, which is twice as large as a value indicated by the left-most significant 9 bits.

<SCLK Period Calculation Part>

Referring back to FIG. 2, the SCLK period calculation part 62 calculates the SCLK calculation value SCW (=DK−DKB) representing a period of the reference clock SCLK by executing subtraction processing based on the second measurement output DK and the second measurement output DKB, which is supplied from the border fraction calculation part 63 at timing, which is one clock before. This SCLK period calculation value SCW is not an accurate binary number either as the fraction calculation value SUB calculated by the fraction calculation execution part 632 is not. Therefore, by executing the similar processing of the binary correction part 633, the corrected SCLK period calculation value SCW is outputted.

<Fraction Correction Value Calculation Part>

Figures 8, 9:
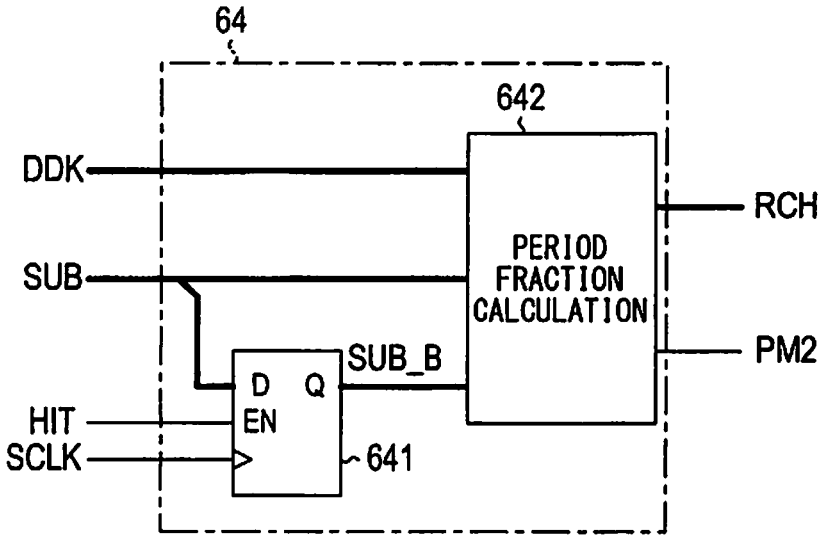
FIG. 8 is a block diagram showing a configuration of a fraction correction value calculation part shown in FIG. 2.
FIG. 9 is a table showing contents of processing of a period fraction calculation part shown in FIG. 2.

The fraction correction value calculation part 64 includes, as shown in FIG. 8, a latch circuit 641 and a period fraction calculation part 642. The latch circuit 641 latches the fraction calculation value SUB at the SCLK timing when the processing timing signal HIT is at the high level. In practice, it latches the fraction calculation value SUB at the SCLK timing at the time of change of the processing timing signal HIT from the high level to the low level. The period fraction calculation part 642 compares the fraction calculation value (end fraction) SUB and the fraction calculation value (start fraction) SUB_B, which is latched by the latch circuit 641 in the previous processing period. The period fraction calculation part 642 generates a RCLK period fraction calculation value RCH and a second correction value PM2 from the comparison result in accordance with a table shown in FIG. 9.

Figure 10A:
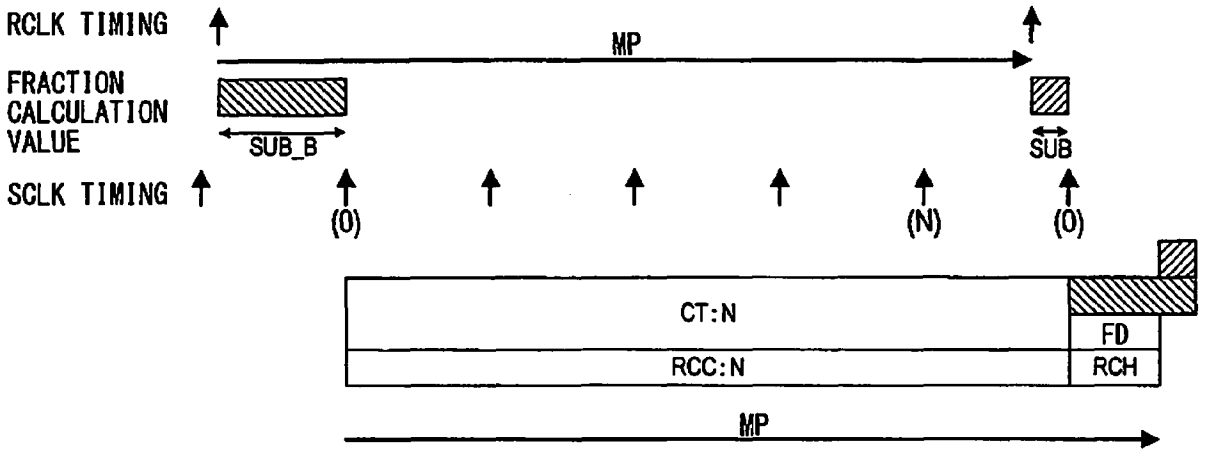
FIG. 10A and FIG. 10B are timing diagrams related to contents of setting of the table shown in FIG. 9 in a case that a start fraction is larger than an end fraction and a case that the start fraction is smaller than the end fraction, respectively.
Figure 10B:
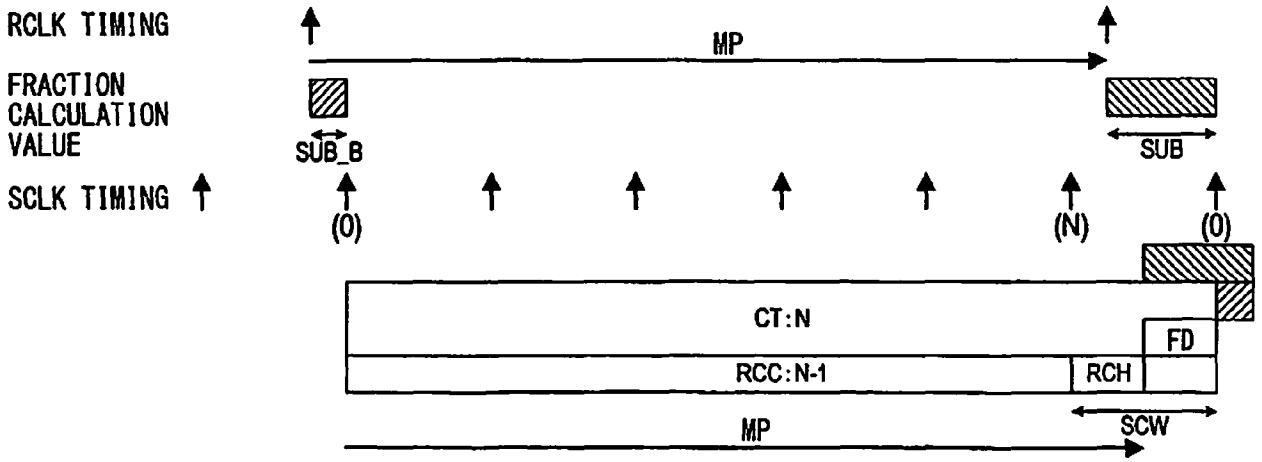

The RCLK period fraction calculation value RCH indicates a remaining time, which remains to be less than the SCLK period as a result of subtracting time of integer times of the period of the reference clock SCLK (referred to as a SCLK period) from one period (measurement period) of the measurement clock RCLK. The RCLK period fraction calculation value RCH indicates the number of stages of the inverter circuits, which the pulse signal passed through, in the ring oscillator 2. As shown in FIG. 10A and FIG. 10B, the start fraction SUB_B is a fraction detected at the start timing of measurement period MP and the end fraction SUB is a fraction detected at the end timing of the measurement period MP.

The RCLK period fraction calculation value RCH is calculated by subtracting SUB from SUB_B in a case of SUB_B≥SUB (refer to FIG. 10A) and by subtracting (SUB-SUB_B) from SCW by using the SCLK period calculation value SCW in a case of SUB_B<SUB (refer to FIG. 10B).

The number of periods of the reference clock SCLK included in the measurement period is equal to a count value of the RCLK period count part 65 in a case of SUB_B≥SUB (refer to FIG. 10A) and equal to be less one from the count value of the RCLK period count part 65 in a case of SUB_B<SUB (refer to FIG. 10B). To indicate this, the second correction value PM2 is set to PM2=0 (count value need not be corrected) in the case of SUB_B≥SU and set to PM2=1 (count value need be corrected) in the case of SUB_B<SUB.

<Count Value Correction Part>

Figures 11, 12:
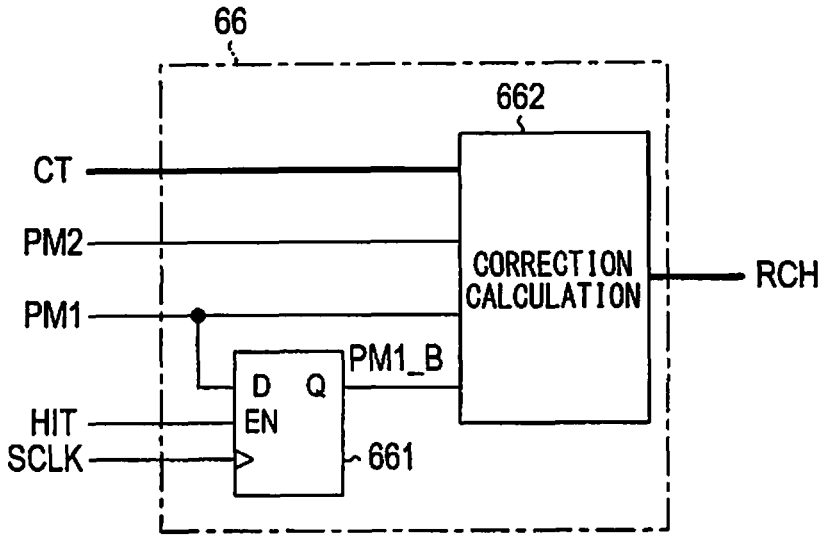
FIG. 11 is a block diagram showing a configuration of a count value correcting part.
FIG. 12 is a table showing contents of processing of a correction calculation part shown in FIG. 2.

The count value correction part 66 includes, as shown in FIG. 11, a latch circuit 661 and a correction calculation part 662. The latch circuit 661 latches the first correction value PM1 at the SCLK timing when the processing timing signal HIT is at the high level. In practice, the latch circuit 661 latches the correction value PM1 at the SCLK timing when the processing timing signal HIT changes from the high level to the low level. The correction calculation part 662 generates a RCLK period count value RCC by correcting a count value CT calculated by the RCLK period count part 65 based on the first correction value PM1, the first correction value PM1_B latched by the latch circuit 661 at the previous processing timing and the second correction value PM2 in accordance with a table shown in FIG. 12.

Figure 13A:
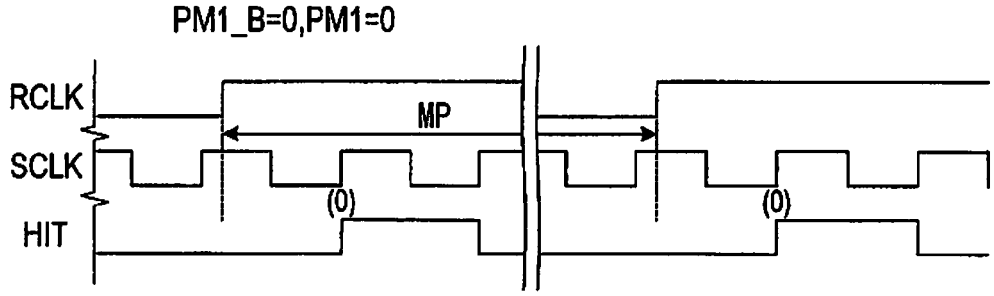
FIG. 13A, FIG. 13B, FIG. 13C and FIG. 13D are timing diagrams related to contents of setting of the table shown in FIG. 12 in a case of PM1_B=0 and PM1=0, a case of PM1_B=1 and PM1=0, a case of PM1_B=0 and PM1=1, and a case of PM1_B=1 and PM1=1, respectively.
Figure 13B:
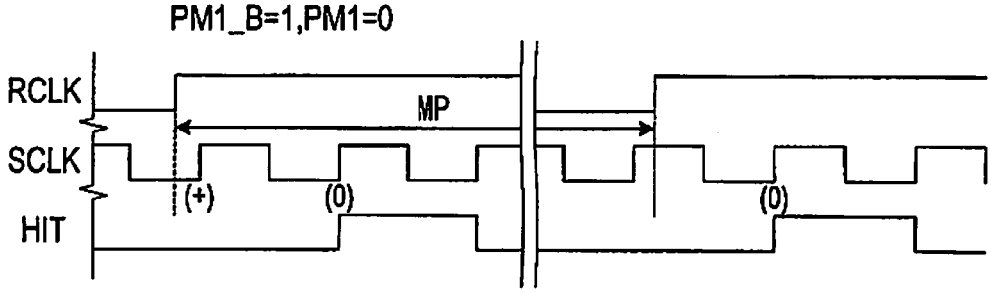
Figure 13C:
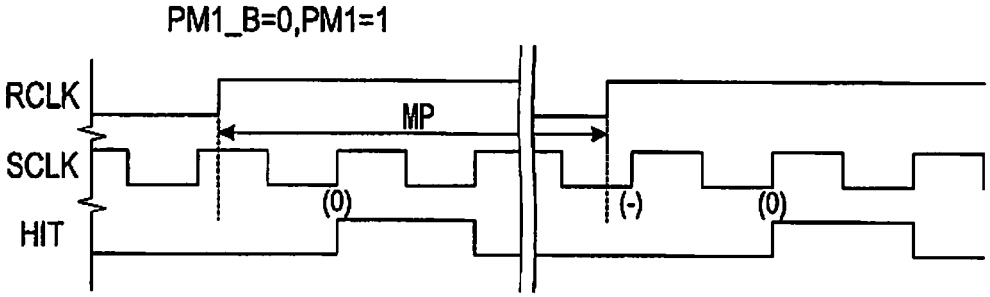
Figure 13D:
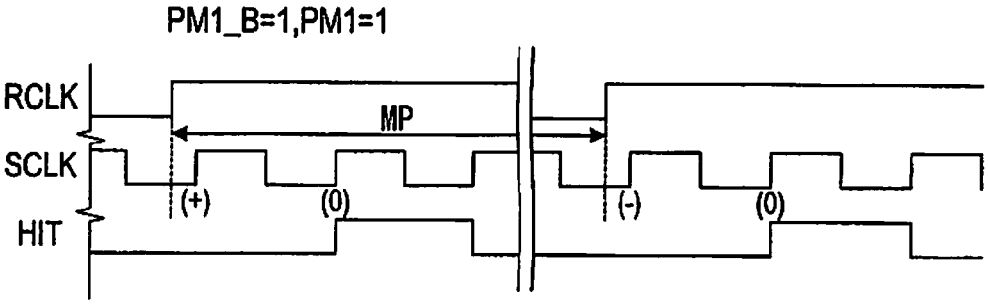

The first correction value PM1 indicates whether the detection stage of the processing timing signal HIT at the RCLK timing is the normal detection state (PM1=0) or the delayed detection state (PM1=1). There are four correction patterns depending on a combination of the first correction value PM1_B at the start timing of the measurement period and the first correction value PM1 at the end timing of the measurement period. That is, when both of the start timing and the end timing are of the normal detection states (PM1_B=0 and PM1=0), counting of the count value CT starts from the SCLK timing, which is immediately after the start timing, and ends at the SCLK timing, which is immediately before the end timing, as shown in FIG. 13A. In this case, the count value CT need not be corrected. When the start timing is of the delayed detection state and the end timing is of the normal detection state (PM1_B=1 and PM1=0), counting of the count value CT starts from the second SCLK timing after the start timing, and ends at the SCLK timing, which is immediately before the end timing, as shown in FIG. 13B. In this case, the count value CT need be incremented by one to correct uncounted one, which is immediately after the start timing. When the start timing is of the normal detection state and the end timing is of the delayed detection state (PM1_B=0 and PM1=1), counting of the count value CT starts from the SCLK timing, which is immediately after the start timing, and ends at the SCLK timing, which is immediately after the end timing, as shown in FIG. 13C. In this case, the count value CT need be decremented by one to correct over-counted one, which is immediately after the end timing. When both of the start timing and the end timing are of the delayed detection states (PM1_B=1 and PM1=1), counting of the count value CT starts from the second SCLK timing, which is after the start timing, and ends at the SCLK timing, which is immediately after the end timing, as shown in FIG. 13D. In this case, the count value CT need be corrected to compensate for the uncounted one, which is immediately after the start timing, and over-counted one, which is immediately after the end timing. However, since the uncounted one and the over-counted one are cancelled out each other, the count value CT need not be corrected in the end.

As described above with reference to the fraction correction value calculation part 64, the count value CT need not be corrected when the second correction value PM2 is PM=0 and need be decremented by one when the second correction value PM2 is PM2=1. That is, the correction calculation part 662 performs a total of eight patterns, which are combinations of the four patterns of the first correction values PM1, PM1_B and the two patterns of the second correction value PM2 (refer to FIG. 12).

<Output Part>

Referring back to FIG. 2, the output part 67 includes, as shown in FIG. 2, latch circuits 671, 672 and 673.

All of the latch circuits 671 to 673 latch respective input values at the SCLK timing when the processing timing signal HIT is at the high level. It is noted that the latch circuit 671 inputs the SCLK period calculation value SCW generated by the SCLK period calculation part 62, the latch circuit 672 inputs the fraction correction value RCH generated by the fraction correction value calculation part 64, and the latch circuit 673 inputs the RCLK period count value RCC generated by the count value correction part 66.

<Operation of Fraction Processing Part>

Figure 14:
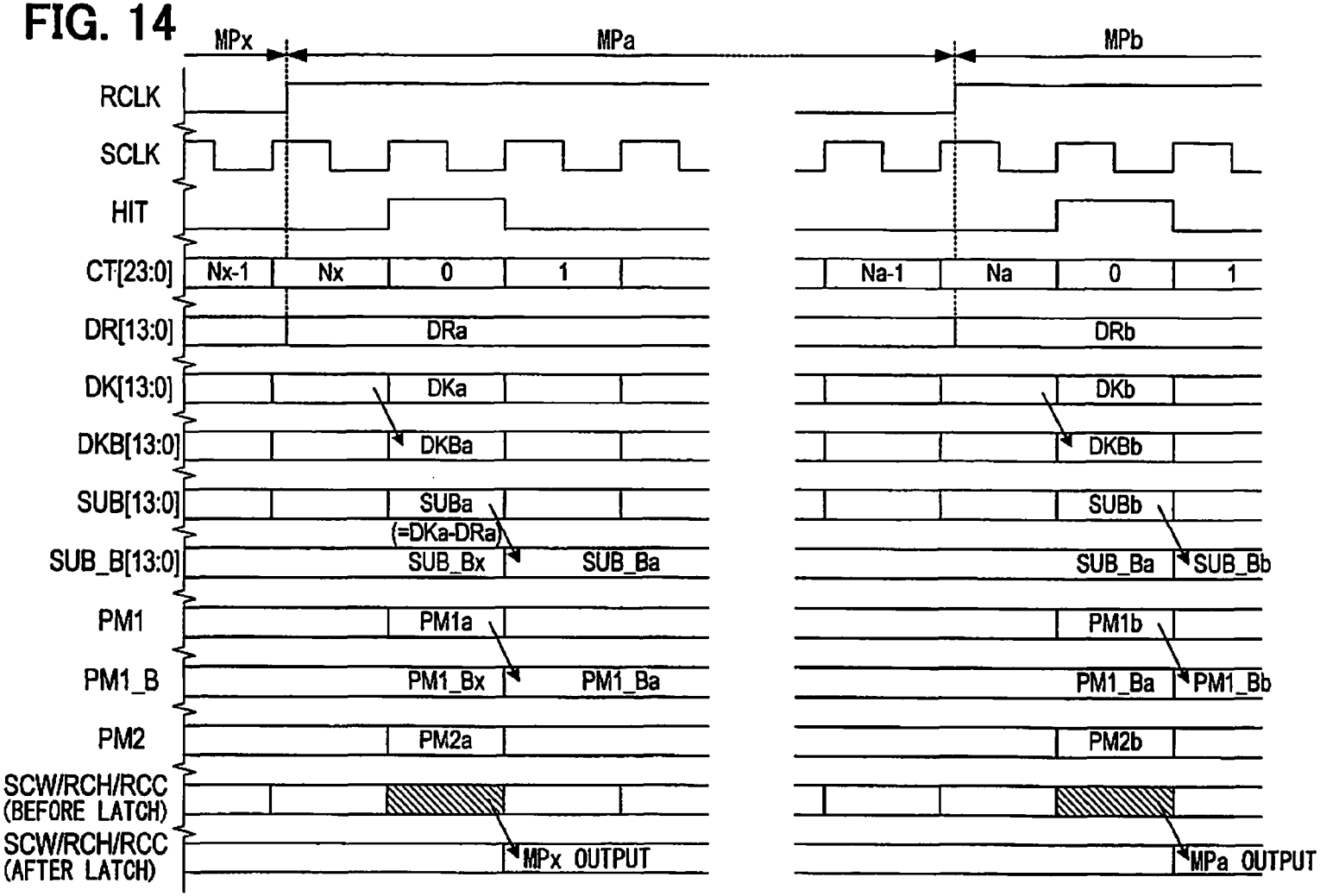
FIG. 14 is a timing diagram showing an entire operation of the fraction processing part shown in FIG. 1 and FIG. 2.
Figure 15A:
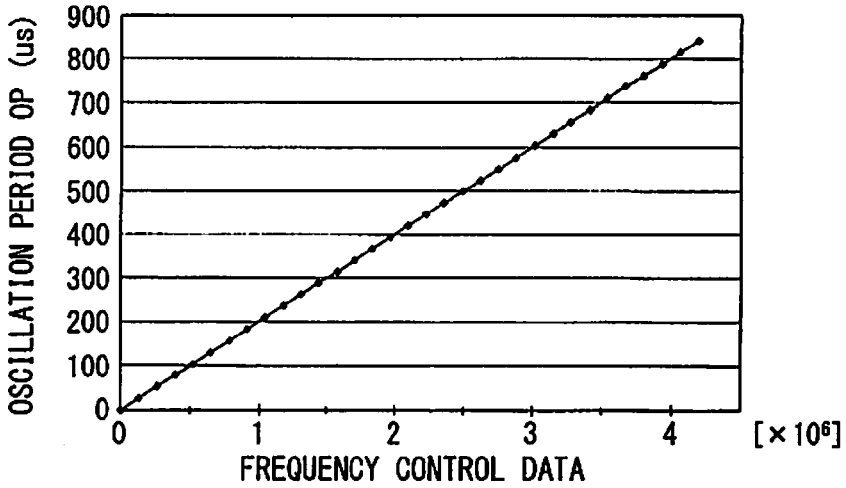
FIG. 15A PRIOR ART
FIG. 15A, FIG. 15B and FIG. 15C are graphs related to problems of a conventional device and showing a relation between a frequency control data and an oscillation period, a relation between the frequency control data and its width of variation and a relation between the frequency control data and its dispersion, respectively.
Figure 15B:
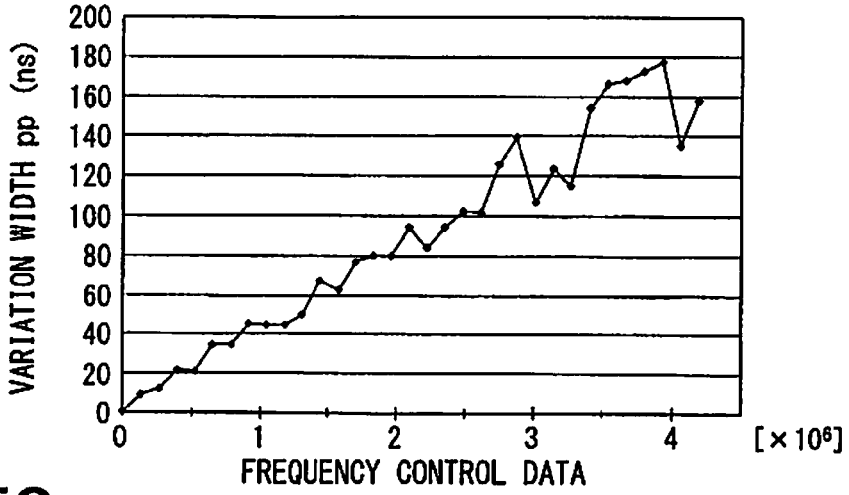
FIG. 15B PRIOR ART
Figure 15C:
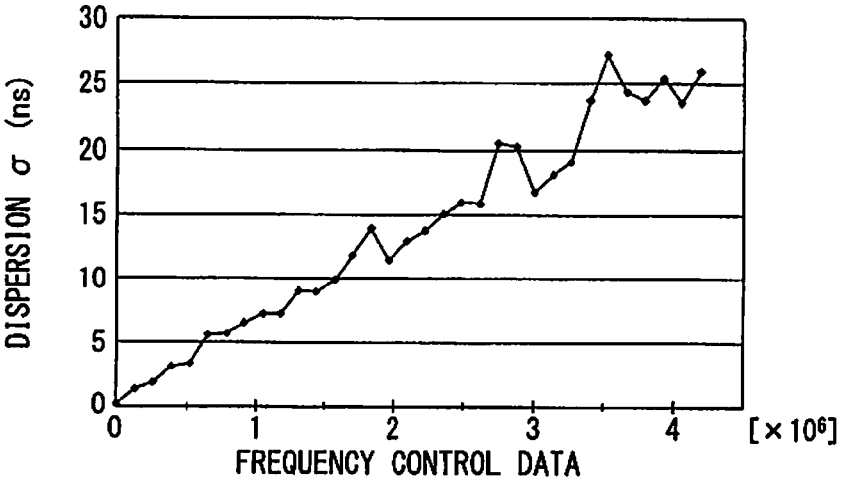
FIG. 15C PRIOR ART

As shown in FIG. 14, the fraction processing part 6 configured as described above generates the count value CT based on the processing timing signal HIT generated from the RCLK timing and the SCLK timing in each measurement period MPx, MPa and MPb. During the processing period, in which the processing timing signal HIT is at the high level, each part in the fraction processing part 6 performs calculations. That is, in the fraction processing part 6, the RCLK period fraction calculation value RCH is generated from the first measurement output DR and the second measurement output DK, the RCLK period count value RCC is generated by correcting the count value CT, and the SCLK period calculation value SCW is generated from the second measurement output DK. The calculation results RCH, RCC and SCW are latched and outputted at the SCLK timing, which is at the end time of the processing period. The SCLK period calculation value SCW is used, for example, when the RCLK period fraction calculation value RCH is converted to a value by using the period of the reference clock SCLK as the reference (for example, 1).

[Advantage]

According to the time measuring circuit 1 described above in detail, the measurement value of the RCLK period is expressed by using the RCLK period count value RCC generated by the reference clock SCLK having an accurate period and the RCLK period fraction calculation value RCH generated from the output of the ring oscillator 2. Thus influence of variations included in the output of the ring oscillator 2 is limited to be within a period, which is shorter than the SCLK period. Since the accumulation of such variations is minimized, the time can be measured accurately.

According to the time measurement circuit 1, various uncertainties caused by asynchronization between the measurement clock RCLK and the reference clock SCLK are broken down into patterns and the count value RCC is corrected depending on the patterns. As a result, the time can be measured accurately.

Other Embodiment

The time measuring circuit described above is not limited to the embodiment described above but may be modified differently.

(1) In the embodiment described above, the ring oscillator and the counter circuit are used. Alternatively, a linear delay line, which is formed of simply connecting delay elements in series, may be used.

(2) In the embodiment described above, the ring oscillator is formed of an odd number of inverter circuits and, since the output of the ring oscillator is not a power of 2 (that is, $2^n$), the output is corrected to a binary number at the latter stage. Alternatively, the ring oscillator may be formed to generate an output of a power of 2 and correction to the binary number may be eliminated.

(3) The function performed by one structural element in the embodiment described above may be shared by plural structural elements and the functions shared by plural structural elements may be performed by one structural element. At least a part of configuration of the embodiment described above may be replaced with a conventional configuration, which has the same function. A part of configuration of the embodiment described above may be eliminated. At least a part of configuration of the embodiment described above may be added to a structure of other embodiment or replaced. All embodiments covered by a technical idea defined by words described in patent claims belong to the present disclosure.

(4) The time measuring circuit and its time measuring method may be realized by not only the time measuring circuit itself described above but also by other forms such as a system including the time measuring circuit as one element thereof.

What is claimed is:

1. A time measuring circuit comprising:

a delay line having plural delay elements connected in series for delaying a pulse signal;

a first encoding part for performing an encoding operation, at every reference timing determined by a reference clock, in accordance with a number of stages of the delay elements, which the pulse signal passes through during a period from a preset start timing to the reference timing;

a second encoding part for performing an encoding operation with respect to a measurement start timing and a measurement end timing of a measurement period determined by a measurement signal inputted asynchronously from a reference signal, at every reference timing determined by the reference clock, in accordance with the number of stages of the delay elements, which the pulse signal passes through during the period from the preset start timing to the measurement start timing and from the preset start timing to the measurement end timing;

a count part for counting a number of periods of the reference clock included in the measurement period; and a fraction calculation part for calculating based on encoding results of the first encoding part and the second encoding part a start fraction and an end fraction, the start fraction indicating a time difference from the measurement start timing to the reference timing appearing first after the measurement start timing and the end fraction indicating a time difference from the measurement end timing to the reference timing appearing first after the measurement end timing, and for calculating from the start fraction and the end fraction a fraction data indicating a difference between the measurement period and a period, which is a product of the period of the reference timing and a count value of the count part, thereby to output a count data corresponding to the count value and the fraction data as a measurement value of length of the measurement period.

2. The time measuring circuit according to claim 1, wherein:

the delay line is connected in a ring form.

3. The time measuring circuit according to claim 2, wherein:

a period corresponding to a maximum value of values encoded by the first encoding part and the second encoding part is set to be two times or more as long as the period of the reference timing.

4. The time measuring circuit according to claim 3, further comprising:

a first correction part for outputting the count data by correcting the count value based on a measurement border data, which is an output of the second encoding part at the measurement timing, a reference data, which is an output of the first encoding part at a count start timing of the count part, and an immediately preceding reference data, which is an output of the first encoding part at the reference timing positioned immediately preceding the count start timing, in accordance with a relation of magnitudes among the measurement border data, the reference data and the immediately preceding reference data and in accordance with a determination whether the count starting timing is the measurement start timing or the reference timing, which is immediately after the measurement stat timing.

5. The time measuring circuit according to claim 4, further comprising:

a second correction part for outputting the count data by correcting the count value depending on a relation between magnitudes of the start fraction and the end fraction calculated by the fraction calculation part.

6. The time measuring circuit according to claim 5, further comprising:

a reference period calculation part for generating a period data indicating a period of the reference clock based on the encoding result of the first encoding part, thereby to output the period data in addition to the count data and the fraction data.

7. The time measuring circuit according to claim 1, further comprising:

a correction part for outputting the count data by correcting the count value depending on a relation between magnitudes of the start fraction and the end fraction calculated by the fraction calculation part.

8. The time measuring circuit according to claim 1, further comprising:

a reference period calculation part for generating a period data indicating a period of the reference clock based on the encoding result of the first encoding part, thereby to output the period data in addition to the count data and the fraction data.

* * * * *